US007451997B2

(12) United States Patent
Hauglin

(10) Patent No.: US 7,451,997 B2
(45) Date of Patent: Nov. 18, 2008

(54) SKI BINDING, PARTICULARLY TOURING, TELEMARK, OR CROSS-COUNTRY BINDING

(75) Inventor: Bernt-Otto Hauglin, Royken (NO)

(73) Assignee: Rottefella AS, Klokkarstua (NO)

( * ) Notice: Subject to any disclaimer, the term of this patent is extended or adjusted under 35 U.S.C. 154(b) by 541 days.

(21) Appl. No.: 10/516,977

(22) PCT Filed: May 21, 2003

(86) PCT No.: PCT/IB03/02132

§ 371 (c)(1),
(2), (4) Date: Jul. 11, 2005

(87) PCT Pub. No.: WO03/101555

PCT Pub. Date: Dec. 11, 2003

(65) Prior Publication Data

US 2005/0248128 A1 Nov. 10, 2005

(30) Foreign Application Priority Data

Jun. 4, 2002 (DE) ..... 102 24 746

(51) Int. Cl.
*A63C 9/02* (2006.01)

(52) U.S. Cl. ..... 280/618; 280/614; 280/615

(58) Field of Classification Search ..... 280/614, 280/615, 616, 617, 618, 619, 620, 635
See application file for complete search history.

(56) References Cited

U.S. PATENT DOCUMENTS 2,094,667 A * 10/1937 Parish ..... 280/618
4,273,355 A 6/1981 Storandt
4,322,090 A * 3/1982 Loughney ..... 280/614
4,887,833 A * 12/1989 Bailey ..... 280/615
7,207,591 B2 * 4/2007 Riedel et al. ..... 280/614
7,264,263 B2 * 9/2007 Riedel et al. ..... 280/614

FOREIGN PATENT DOCUMENTS

| | | |
|---|---|---|
| DE | 24 18 577 A | 10/1975 |
| DE | 27 14 853 A | 10/1978 |
| DE | 27 28 747 A | 1/1979 |
| DE | 195 17 791 A1 | 5/1995 |
| DE | 200 07 032 U1 | 9/2000 |

(Continued)

*Primary Examiner*—Paul N. Dickson
*Assistant Examiner*—John D Walters
(74) *Attorney, Agent, or Firm*—Knobbe Martens Olson & Bear LLP

(57) ABSTRACT

Touring, telemark or cross-country ski binding (10) for securing a ski boot comprising a leg and a sole, having a front retaining element (12) associated with the front end of the sole, a rear retaining element (15) formed to engage on the foresole or on the heel of the ski boot, and a biasing device (19), effective between the front and rear retaining elements, by means of which the ski boot is clampable between the front and rear retaining elements in such a manner that the heel thereof is freely liftable.

The front retaining element (12) is pivotally mounted relative to the binding (10, 11) and the ski on the one hand, and relative to the rear retaining element (15) on the other hand, about an axis (13) which extends transversely to the longitudinal direction of the binding and sole and approximately parallel to the sole tread.

10 Claims, 3 Drawing Sheets

FOREIGN PATENT DOCUMENTS

| | | | |
|---|---|---|---|
| EP | 0 806 977 | A | 11/1997 |
| EP | 0 820 790 | A | 1/1998 |
| EP | 0 908 204 | A2 | 4/1999 |
| EP | 0 951 926 | A | 10/1999 |
| FR | 2 803 178 | A1 | 12/1999 |
| WO | WO 01 66204 | A | 9/2001 |

* cited by examiner

SKI BINDING, PARTICULARLY TOURING, TELEMARK, OR CROSS-COUNTRY BINDING

The invention relates to a ski binding according to the preamble of claim 1.

Unlike alpine bindings, a defining functional feature of touring, telemark or cross-country bindings is that, although the associated ski boot is held on the ski at the front end of the sole by a retaining element, the rear end of the sole, that is, the heel, may not be held in fixed position on the ski and must be liftable in relation thereto. Meeting that elementary requirement, which is derived from the movements carried out in cross-country or touring skiing or skiing in the telemark style, is generally associated in earlier binding constructions with losses in terms of the guidance properties of the binding.

There have been known and used in practice for years, however, cross-country, touring and telemark bindings in which good lateral guidance is achieved, at least in the locating of the ski boot mounted on the binding, by means of corresponding regions of engagement on the binding and on the ski boot fitted to the binding. A ski binding according to the preamble of claim 1 is known from EP 0 806 977 B1. In an advantageous form of construction, the ski binding has, engaging on the underside of the foresole of the boot, a biasing element which is formed especially as a flexurally resilient element in the form of a resilient strap or plate. That ski binding has good guidance and force-transfer properties but there is still a need for improvement in respect of effort in cross-country skiing and ski touring.

The aim of the present invention is to provide a ski binding of the generic kind that, with good guidance and force-transfer properties remaining unchanged, is distinguished by a low level of effort in ski touring and cross-country skiing, that is to say in lifting the heel of the boot.

The aim is achieved in accordance with the invention by the characterising features of claim 1, advantageous constructional details and embodiments being described in the subclaims.

The essence of the present invention thus resides in the front retaining element which, for example, may be formed in the manner of a toe bail and is pivotally mounted relative to the binding and the ski on the one hand, and relative to the rear retaining element on the other hand, about an axis that extends transversely to the longitudinal direction of the sole and approximately parallel to the sole tread. The front retaining element is thus of quasi "dynamic" form. The result is that, when the heel of the boot is raised, the front retaining element barely offers any resistance. This is achieved as a result of the fact that the front retaining element is able to follow the movement of the front end of the sole relative to the rear retaining element and to a connecting member between front and rear retaining elements. The front end of the sole is thus not unavoidably pushed down by the front retaining element onto the upper side of the binding and onto the top face of the ski in such a manner that the front end of the sole always extends parallel to the top face of the ski, and independently of the lifting of the heel of the boot.

Preferably, there is associated with the front retaining element, in front of the pivotal axis thereof, a resilient element, namely a flexor in the form of a rubber or elastomer cushion, between which element and the portion of the front retaining element that engages over the front end of the sole the front end of the sole can be placed. The heel of the boot can be lifted against the action of that flexor. This effects the necessary restoration of the ski to the sole tread desired during so-called diagonal skiing. If required, the flexor can be removed. As a result, lifting of the heel of the boot is additionally simplified. The removal of the flexor is provided especially for ski touring, that is when climbing with skins or similar climbing aids. The same applies also in telemark skiing. In that case, too, the mentioned flexor is more of a hindrance, so that it is advantageous for the flexor to be removable when required. It behaves differently in so-called diagonal cross-country skiing. In the case of that skiing style, it is desired and intentional that a restoring force, especially a progressively increasing restoring force, is created between boot and binding in dependence upon the heel of the boot being lifted.

There may be mentioned as especially advantageous the arrangement of a biasing device, especially a spring biasing device, between rear and front retaining elements, by means of which clamping of the ski boot between the front and rear retaining elements is ensured. The biasing device is so formed that the rear retaining element is movable in the longitudinal direction of the boot and ski against the action of a spring which pre-biases the rear retaining element in the forward direction. As a result, relative movements of the sole between front and rear clamping points when the heel of the boot is lifted can be compensated without any adverse effect on the securing of the boot.

In order to increase safety in the event of torsional forces on the boot, it may be advantageous for the rear retaining element to comprise two jaws, pivotable about approximately vertical axes, which can be pivoted out laterally against the action of a resilient element, especially a compression spring or torsion springs, to release the boot laterally.

The rear retaining element may be in the form of a retaining cable or a retaining bracket, especially in the form of a retaining bracket that engages on the underside of the foresole. Reference is made in that connection to the prior art, e.g. according to EP 0 908 204 A2 or EP 0 951 926 A1, or WO 01/66204 A1, prior art attributable to the Applicants. That prior art is, however, additionally characterised in that the front retaining element is rigidly secured to the binding and thus to the ski. In the prior art according to WO 96/23558, likewise attributable to the Applicants, although the front retaining element is pivotally mounted about a horizontal transverse axis, the mounting allows pivotal movement only relative to the binding and to the ski, but not relative to the rear retaining element and to a connecting member between the front and rear retaining elements. Accordingly in that embodiment, too, the front end of the sole is subject to a constraint when the heel of the boot is lifted.

Finally, attention may also be drawn to the fact that the rear retaining element is in principle held in the open or step-in position by a locking mechanism which is released on stepping into the binding, with the result that the retaining element then passes into the boot-securing position owing to the action of the biasing device.

A preferred embodiment of the binding according to the invention is described in detail in the following with reference to the accompanying diagrams in which.

Figure 1:
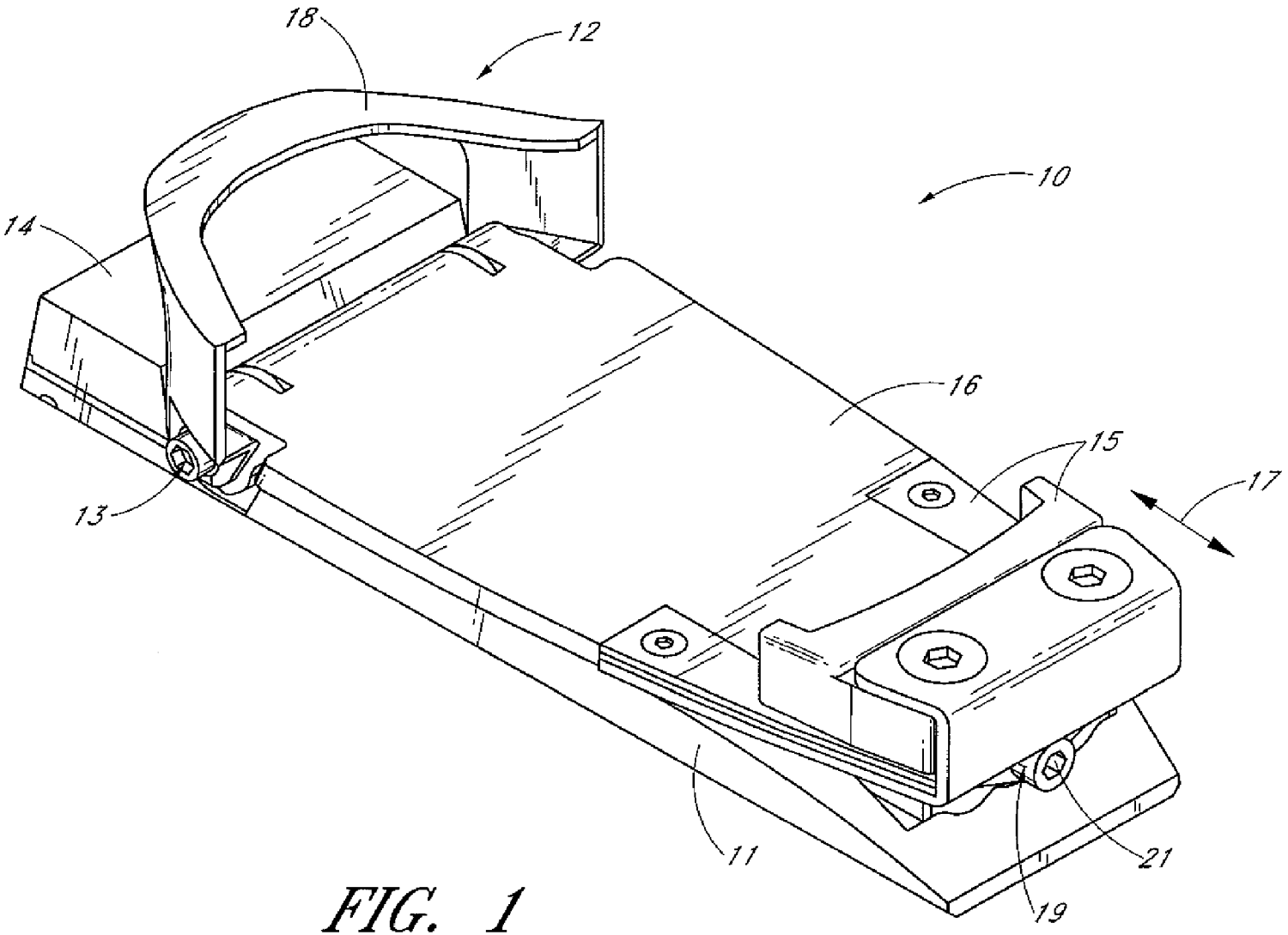
FIG. 1 is a diagrammatic perspective view of a ski binding formed in accordance with the invention.
Figure 2:
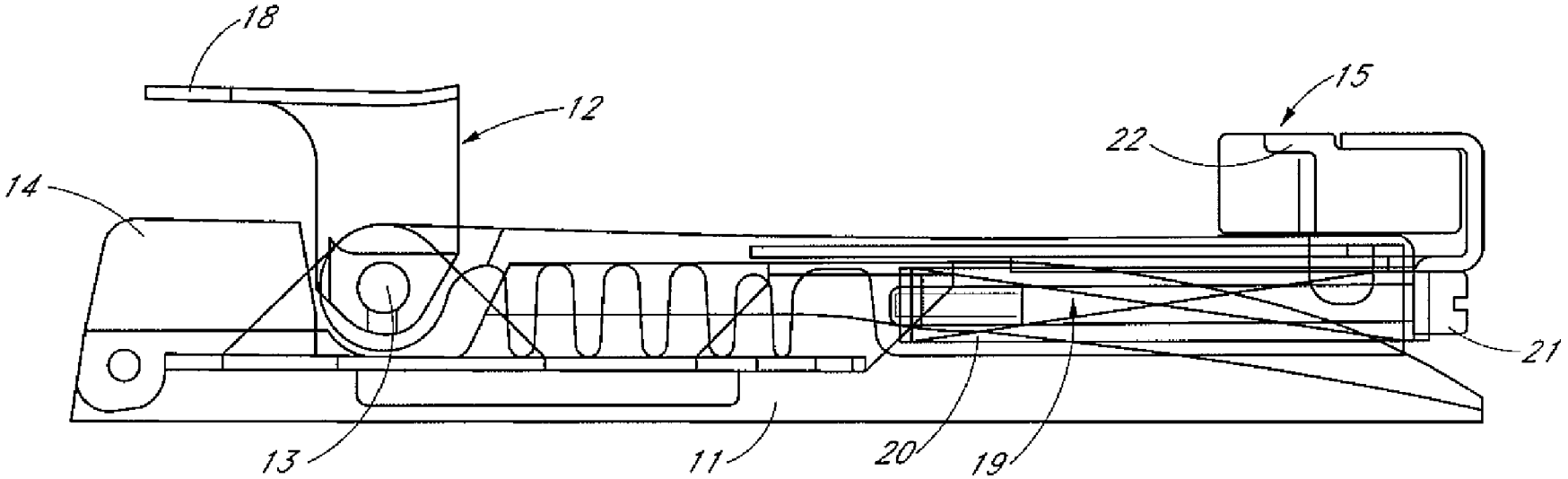
FIG. 2 is a diagrammatic lateral view of the binding according to FIG. 1.
Figure 3:
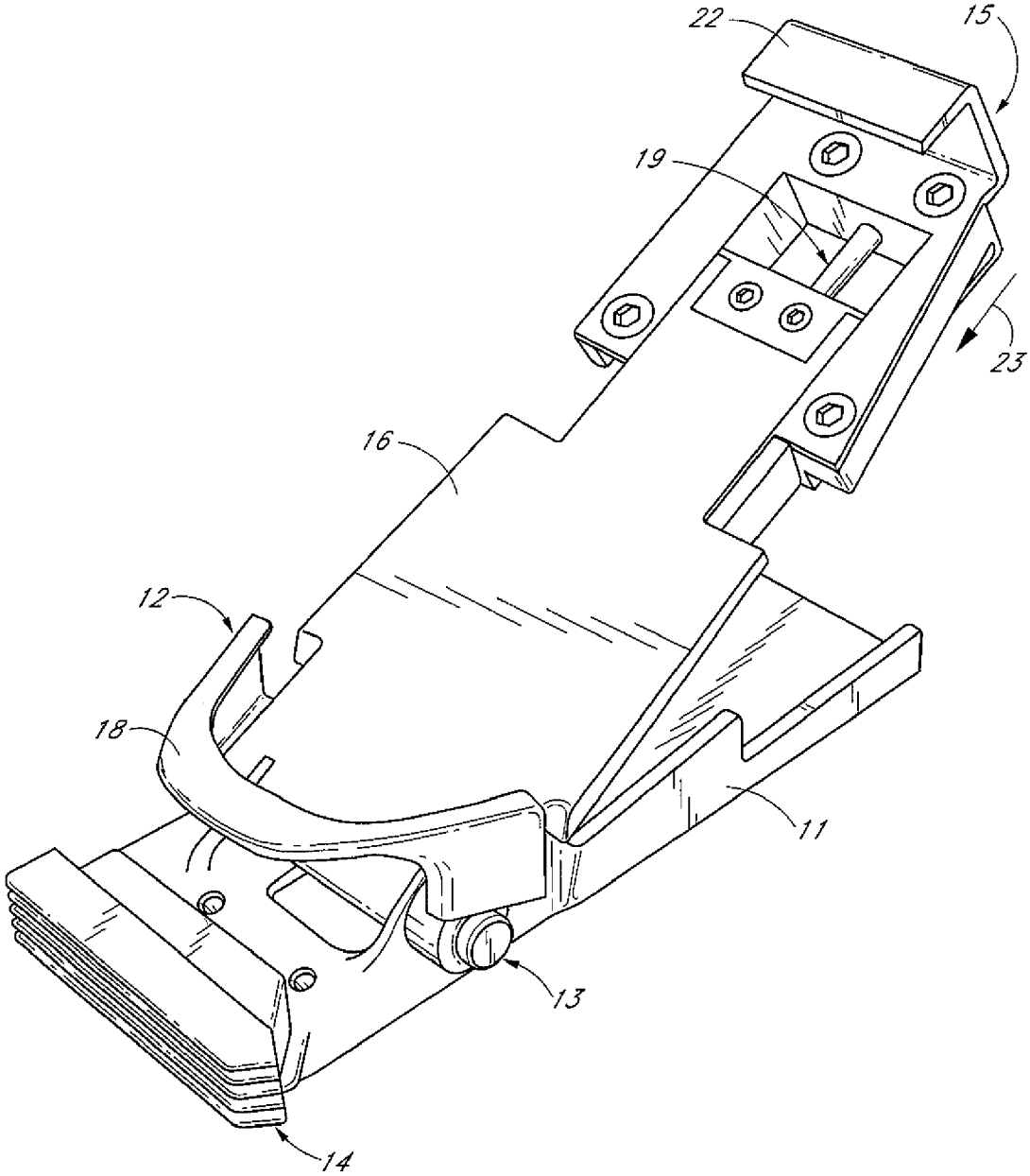
FIG. 3 is a view, likewise in perspective, of the binding according to FIG. 1 in the open step-in position, with the rear retaining element raised and with the connecting plate between the front and rear retaining elements pivoted upwards.

The ski binding shown diagrammatically in FIGS. 1 to 3, which is formed as a touring, telemark or cross-country ski binding, is identified by the reference numeral 10. It comprises a mounting plate 11, mountable on the top face of a ski (not shown). A front retaining element 12 is pivotally mounted on the upper side about an axis 13 which extends parallel to the top face of the ski and to the mounting plate 11 and transversely to the longitudinal direction thereof. The front retaining element 12 is formed in the manner of a toe bail. It comprises a U-shaped bracket, which engages over the front end of the sole of a ski boot (not shown) and holds it on the binding.

There is associated with the front retaining element 12, in front of the pivotal axis 13 thereof, a resilient element in the form of a rubber or elastomer cushion 14. The front end of the sole of the ski boot (not shown) is positionable between that resilient element or flexor 14 and the portion of the front retaining element 12 that engages over the front end of the sole. Accordingly, the heel of the boot can be raised upwards against the action of the flexor 14. If required, the resilient element or flexor 14 is removable.

About the already mentioned pivotal axis 13 about which the front retaining element is pivotally mounted there is pivotally mounted, independently thereof, a rear retaining element 15, which is movably arranged at the rear end of a plate-like connecting member 16 so as to be longitudinally displaceable (double arrow 17). To be precise, therefore, the rear retaining element 15 is pivotally mounted on the mounting plate 11 about the pivotal axis 13 by way of the connecting member 16. This pivotal mounting is independent of the pivotal mounting of the front retaining element 12. The independent pivotal mounting of the front retaining element 12 and the rear retaining element 15 is the basis of the present construction. The connecting member 16 is preferably formed as a plate which is flexurally resilient in the longitudinal section plane of the binding 10. In principle, a rigid plate is also possible, especially when the rear retaining element 15 engages on the rear end of the foresole or in the ball region of the ski boot.

The bracket, engaging over the front end of the sole of the ski boot, of the front retaining element 12 is indicated in the accompanying Figures by the reference numeral 18.

Arranged between the rear retaining element 15 and the front retaining element 12 is a biasing device 19, especially a spring biasing device. To be precise, the spring biasing device comprises at least one, preferably two, longitudinally extending compression springs 20, which pre-bias the rear retaining element 15 in a forward direction, that is to say into the boot-securing position. The spring bias can be adjusted by means of a biasing screw 21.

As has already been mentioned, provision is to be made for the rear retaining element 15 to be fixable in the open position of the binding, the fixation being releasable on stepping into the binding (step-in mechanism).

The rear element 15 comprises a retaining bracket 22 which engages on the underside of the foresole of a ski boot (not shown). The retaining bracket is open towards the front. As mentioned at the outset, the rear retaining element may also be in the form of two parts and may especially comprise two jaws, pivotable about approximately vertical axes, which can be pivoted out laterally against the action of a resilient element, especially torsion springs, to release the ski boot laterally. This form of construction is not shown here. However it represents a not insignificant safety element, especially in the event of excessive torsional forces occurring.

In FIG. 3, the rear retaining element 15 is in its open position. On stepping into the binding and pressing down the connecting plate 16, the locking of the rear retaining element 15 in its open position is removed. Under the action of a biasing device (not shown), the retaining element is then moved forwards in the direction of the arrow 23 into the closed position.

There is in addition preferably associated with the front retaining element 12 a centering spring, especially in the form of a torsion spring, which always brings the retaining element 12 into a normal position in which the bracket 18 extends approximately horizontally. The centering spring is relatively weak. Its sole purpose is to keep the front retaining element 12 in normal position; it should not, however, hinder the relative movement of the retaining element 12 with respect to the rear retaining element 15 and connecting member 16 on the one hand, and the mounting plate 11 on the other hand.

The rear retaining element 15 is in addition connected to an operating means (not shown here) by means of which the retaining element is movable into the open position, that is to say backwards, until a locking mechanism is activated that holds the retaining element 15 in the open position until stepping into the binding occurs.

All of the features disclosed in the application documents are claimed as important to the invention insofar as they are novel, individually or in combination, compared with the prior art.

REFERENCE NUMERALS

10 ski binding
11 mounting plate
12 front retaining element
13 pivotal axis
14 flexor
15 rear retaining element
16 connecting member or connecting plate
17 double arrow
18 bracket
19 biasing device
20 compression spring(s)
21 biasing screw
22 retaining bracket
23 arrow

The invention claimed is:

1. A binding selected from the group consisting of a ski binding, a touring ski binding, a telemark ski binding, and a cross-country ski binding, for securing a ski boot comprising a leg and a sole, said binding having a front retaining element operatively associated in use with the front end of the sole, a rear retaining element formed to engage on an element selected from the group consisting of the foresole and the heel of the ski boot, and a biasing device operative between said front and rear retaining elements, by means of which the ski boot is clampable between the front and rear retaining elements in such a manner that the heel thereof is freely liftable, wherein said front retaining element is pivotally mounted relative to the binding and the ski on the one hand, and relative to said rear retaining element on the other hand, about an axis which extends transversely to the longitudinal direction of the binding and sole and approximately parallel to the sole tread, and said rear retaining element is pivotally mounted about an axis which extends transversely to the longitudinal direction of the binding and sole or ski and approximately parallel to the sole tread and to the top face of the ski, wherein said front retaining element is a bracket which engages over the front end of the sole of the ski boot, which bracket is pivotally mounted on the binding, about a horizontally extending transverse axis, both relative to the binding and to a component selected from the group consisting of a mounting plate associated therewith, and a housing associated therewith, and relative to the rear retaining element, and in which the pivotal axis for the rear retaining element coincides with the pivotal axis for the front retaining element;

and wherein said rear retaining element is fixable in the open position of the binding, the fixation being releasable on stepping into the binding by means of a step-in mechanism.

2. The binding according to claim 1, wherein arranged between the rear retaining element and the front retaining element is a device selected from the group consisting of a biasing device, and a spring biasing device.

3. The binding according to claim 1, further comprising a connecting member having a front end and a rear end, wherein said connecting member is pivotally mounted about a horizontal transverse axis, wherein the rear retaining element is mounted at the rear end of said connecting member so as to be longitudinally displaceable, the pivotal axis of said connecting member defining the pivotal axis associated with the said rear retaining element.

4. The binding according to claim 3, wherein the connecting member is a plate which is flexurally resilient in the longitudinal section plane of the binding.

5. The binding according to claim 4, wherein said biasing device is arranged on the said connecting member.

6. The binding according to claim 1, wherein by means of an operating mechanism, the said rear retaining clement is movable against the action of said biasing device into the open position.

7. The binding according to claim 1, wherein the said rear retaining element comprises an element selected from the group consisting of a retaining cable, a retaining bracket, and a retaining bracket which engages on the underside of the foresole.

8. The binding according to claim 1, wherein the front retaining element is formed in the manner of a pivotally mounted toe bail.

9. A binding selected from the group consisting of a ski binding, a touring ski binding, a telemark ski binding, and a cross-country ski binding, for securing a ski boot comprising a leg and a sole, said binding having a front retaining element operatively associated in use with the front end of the sole, a rear retaining element formed to engage on an element selected from the group consisting of the fore sole and the heel of the ski boot, and a biasing device operative between said front and rear retaining elements, by means of which the ski boot is clampable between the front and rear retaining elements in such a manner that the heel thereof is freely liftable, wherein said front retaining element is pivotally mounted relative to the binding and the ski on the one hand, and relative to said rear retaining element on the other hand, about an axis which extends transversely to the longitudinal direction of the binding and sole and approximately parallel to the sole tread, and said rear retaining element is pivotally mounted about an axis which extends transversely to the longitudinal direction of the binding and sole or ski and approximately parallel to the sole tread and to the top face of the ski, wherein said front retaining element is a bracket which engages over the front end of the sole of the ski boot which bracket is pivotally mounted on the binding, about a horizontally extending transverse axis, both relative to the binding and to a component selected from the group consisting of a mounting plate associated therewith, and a housing associated therewith, and relative to the rear retaining element and in which the pivotal axis for the rear retaining element coincides with the pivotal axis for the front retaining element, and wherein the said rear retaining element comprises two jaws pivotable about approximately vertical axes, which jaws can be pivoted out laterally against the action of an element selected from the group consisting of a resilient element, a compression spring, and a torsion spring, to release the ski boot laterally.

10. A binding selected from the group consisting of a ski binding, a touring ski binding, a telemark ski binding, and a cross-country ski binding, for securing a ski boot comprising a leg and a sole, said binding having a front retaining element operatively associated in use with the front end of the sole, a rear retaining element formed to engage on an element selected from the group consisting of the foresole and the heel of the ski boot, and a biasing device operative between said front and rear retaining elements, by means of which the ski boot is clampable between the front and rear retaining elements in such a manner that the heel thereof is freely liftable, wherein said front retaining element is pivotally mounted relative to the binding and the ski on the one hand, and relative to said rear retaining element on the other hand, about an axis which extends transversely to the longitudinal direction of the binding and sole and approximately parallel to the sole tread, and said rear retaining element is pivotally mounted about an axis which extends transversely to the longitudinal direction of the binding and sole or ski and approximately parallel to the sole tread and to the top face of the ski, wherein said front retaining element is a bracket which engages over the front end of the sole of the ski boot, which bracket is pivotally mounted on the binding, about a horizontally extending transverse axis, both relative to the binding and to a component selected from the group consisting of a mounting plate associated therewith, and a housing associated therewith, and relative to the rear retaining element, and in which the pivotal axis for the rear retaining element coincides with the pivotal axis for the front retaining element, and wherein there is associated with the front retaining element, in front of the pivotal axis thereof, a resilient element between which element and the portion of the front retaining element that engages over the front end of the sole the front end of the sole can be placed, the resilient element being removable.

* * * * *